United States Patent [19]

Creamer et al.

[11] Patent Number: 4,941,603

[45] Date of Patent: Jul. 17, 1990

[54] INSULATED BACKPACK

[76] Inventors: John J. Creamer, 3207 Illinois Rd., Wilmette, Ill. 60091; John Muller, 720 Mountain Rd., West Hartford, Conn. 06117

[21] Appl. No.: 26,114

[22] Filed: Mar. 16, 1987

[51] Int. Cl.[5] ..... A45F 3/04

[52] U.S. Cl. ..... 224/148; 224/202; 224/205; 383/4; 150/109; D3/32; 190/111

[58] Field of Search ..... 224/259, 151, 209-216, 224/148, 202, 205; 383/4, 110; 150/109, 110, 111; D3/32; 190/111

[56] References Cited

U.S. PATENT DOCUMENTS

| | | | |
|---|---|---|---|
| 2,164,493 | 7/1939 | Branen | 190/111 |
| 2,517,757 | 8/1950 | Adlerstein | 224/210 X |
| 2,705,063 | 3/1955 | Torrent | 190/111 |
| 2,730,151 | 1/1956 | Smith | 383/110 X |
| 2,954,891 | 10/1960 | Imber | 383/110 X |
| 3,110,334 | 11/1963 | Taylor | 383/66 X |
| 3,292,747 | 12/1966 | Dawson | 190/111 X |
| 3,759,356 | 9/1973 | Bostick et al. | 190/111 |
| 3,870,132 | 3/1975 | Hanley | 190/109 |
| 3,963,102 | 6/1976 | Carp | 190/111 X |
| 3,980,216 | 9/1976 | Nye | 224/209 |
| 4,082,208 | 4/1978 | Lane, Jr. | 224/209 |
| 4,236,615 | 12/1980 | Ginat | 190/111 |
| 4,513,895 | 4/1985 | Leslie | 224/259 X |
| 4,537,313 | 8/1985 | Workman | 383/110 X |
| 4,561,576 | 12/1985 | Lowe et al. | 224/151 X |
| 4,648,121 | 3/1987 | Lowe | 224/209 X |
| 4,662,550 | 5/1987 | O'Donnell | 224/259 X |
| 4,673,117 | 6/1987 | Calton | 224/151 |
| 4,706,856 | 11/1987 | Jacober | 224/151 |

*Primary Examiner*—Henry J. Recla

*Attorney, Agent, or Firm*—Joseph R. Carvalko, Jr.

[57] ABSTRACT

This invention relates to a backpack having enclosed compartments suitable for storing and transporting articles requiring thermally insulated and waterproof protection. The backpack is comprised of two-sections, one of which is a thermally insulated compartment for carrying articles that need to be kept cold or warm. The structure of the apparatus is flexible and formed from a combination of composite material sandwiched between an inner and an outer flexible material. Shoulder or carrying straps and a waist strap are integrally connected to the housing so as to adapt to the wearers shoulders and waist.

3 Claims, 1 Drawing Sheet

INSULATED BACKPACK

BACKGROUND OF THE INVENTION

I. Field of the Invention

The present invention generally relates to a backpack and more particularly is concerned with an article which can be carried on the back in the manner of a napsack for transporting goods. In recent years, there has been a substantial increase in sporting activities particularly camping and hiking. Furthermore, there has been an increase in the numbers of persons who prefer to carry objects in a napsack or backpack rather than in a brief case or other forms of luggage. Individuals engaged in hiking, camping, fishing and other sports, necessitating the carrying of small objects, frequently require a backpack that will also be adaptable to items that need to be thermally protected and protected from the elements.

II. Description of the Prior Art

One article which has been used to meet the needs of sportsmen, particularly hikers, is described and illustrated in U.S. Pat. No. 2,456,253, G. E. Bushey. The Bushey patent discloses a carrier pack wherein a unitary compartment in the shape of a rectangular box has mounted on it straps which allow the user to carry various articles. In another backpack, U.S. Pat. No.3,144,014, C. Mantell, Jr., discloses the basic Bushey box arrangement, but in addition incorporates a recessed extension where a sleeping bag or tent can be rolled up and inserted. U.S. Pat. No. 3,902,640, issued to Geiben, relates to a two-section, semi-rigid hikers backpack having a lower section comprising a structurally reinforced, molded open basket, to which shoulder and waist straps are adjustably attached. Finally, U.S. Pat. No. 4,318,502, issued to Greg E. Lowe, et al, discloses a backpack having an enclosed volume for storing and transporting materials. This particular backpack also includes a horizontal extension adjusting bar for distributing the weight of the backpack more evenly. It also has other adjustable leg straps with connectors, and adjusting means, to adjust the center of gravity of the weight of the backpack.

While each of these articles, or variations of them, have been used extensively for backpacking, each have serious drawbacks. With the exception of the Geiben patent, none earlier than this one disclosed a two-section backpack. That is, one that is divided in some manner between an upper and lower part. However, the Geiben patent is distinct from this invention, in that the Geiben patent uses a two-section, semi-rigid material, comprised of a structurally reinforced and molded open basket. None of these patents address the issue of an insulated bottom compartment. Each is relatively limited in so far as the access to either compartment is concerned, and cannot be easily converted to a daypack or bookpack, for people who merely want to use it as one would use a brief case or large pocketbook. Consequently a need exists for improvements in backpacking equipment which will result in greater flexibility for both sporting and general use.

SUMMARY OF THE INVENTION

The present invention provides a dual compartment backpack designed to satisfy the aforementioned needs. This invention discloses a backpack having a plurality of compartments which includes at least one compartment that it thermally insulated for carrying either warm or cold articles within a lower end portion of the backpack. There is at least one other compartment which in the preferred embodiment is an upper compartment as well which is not insulated. This backpack utilizes a housing formed from a combination of semi-flexible, composite, insulated, and waterproof material, as the means to insulate the lower section. The composite material is located between layers of the semi flexible material in an area surrounding the thermally insulated compartments. The inventors herein have chosen certain insulated materials which have insulation properties or R-values which will keep articles cold and at the same time will keep the coldness of the articles from reaching the back of the user. In addition, there are doors or access panels which allow the user access to the upper and lower internal compartments.

The backpack containing two compartments (including a thermally insulated compartment) is comprised of a housing which is shaped to fit around a perimeter of the opening. There are means for supporting the compartments within the housing which is adapted to the housing so as to surround an access opening located at a rear side of the housing for allowing access to the compartments. There is furthermore a receiving channel which defines the perimeter of the openings.

Each of the compartments (the lower and upper compartments) are divided by a thermally insulated barrier which can be removed by sealable means, but which seals in place and separates each of the compartments when the thermal compartment is in use. The dividing member between the upper and lower compartments is comprised of a shelf which is pivotably supported on the housing and can be moved in an upright position when the upper and lower compartments are made into one single larger compartment. A sealable means such as a zipper or similar device is attached to the pivotably supported member, so that when it is in use it can be closed up. Carrying straps are integrally attached to the semi-rigid housing and are adjustable thereon to fit comfortably over the wearer's shoulder. When the backback is not in use, it can be compactly folded up around the insulated and firmer lower section. The backpack is worn by a user who inserts his arm or arms and shoulders between either one or two straps depending on which embodiment is preferred and then ties a third supporting strap about his waist.

Finally, there are pouches integrally attached and located outside of the main housing which are used to receive various articles in a zippered, sealed compartment, that lies in substantial alignment with the side panel. There is also a stop attached to the panel and the housing for permitting the panel to open at an angle of approximately 45 degrees to allow acccess to the compartments.

Each of the flags which allow access to each of the upper and lower compartments also have document pouches. These document pouches are an integral part of the flaps and are also zippered. Each is used for carrying articles such as papers or other small items.

Accordingly, the present invention relates to an article for receiving and carrying objects and when not in use can be compactly folded up.

DESCRIPTION OF THE PREFERRED EMBODIMENT

Figure 1:
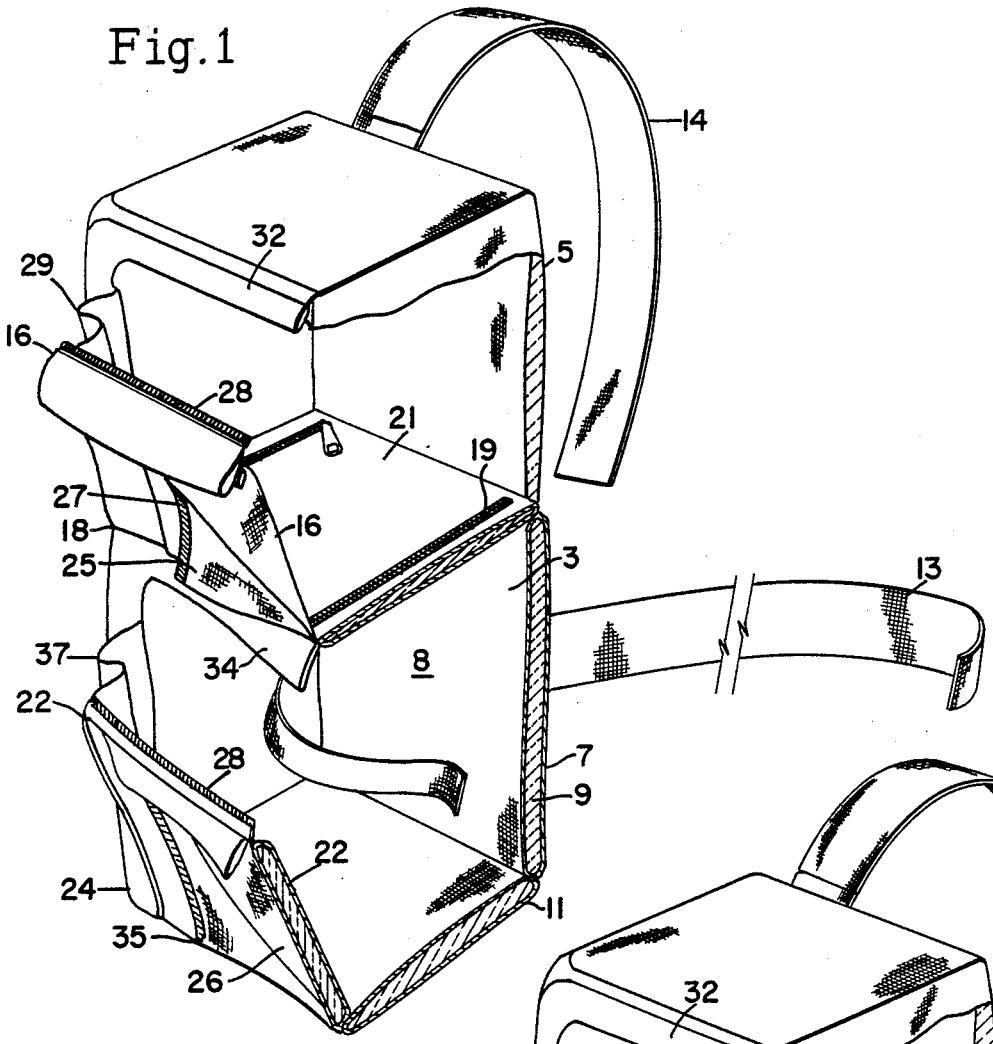
FIG. 1 is a perspective view of the back pack forming one embodiment of the invention.
Figure 2:
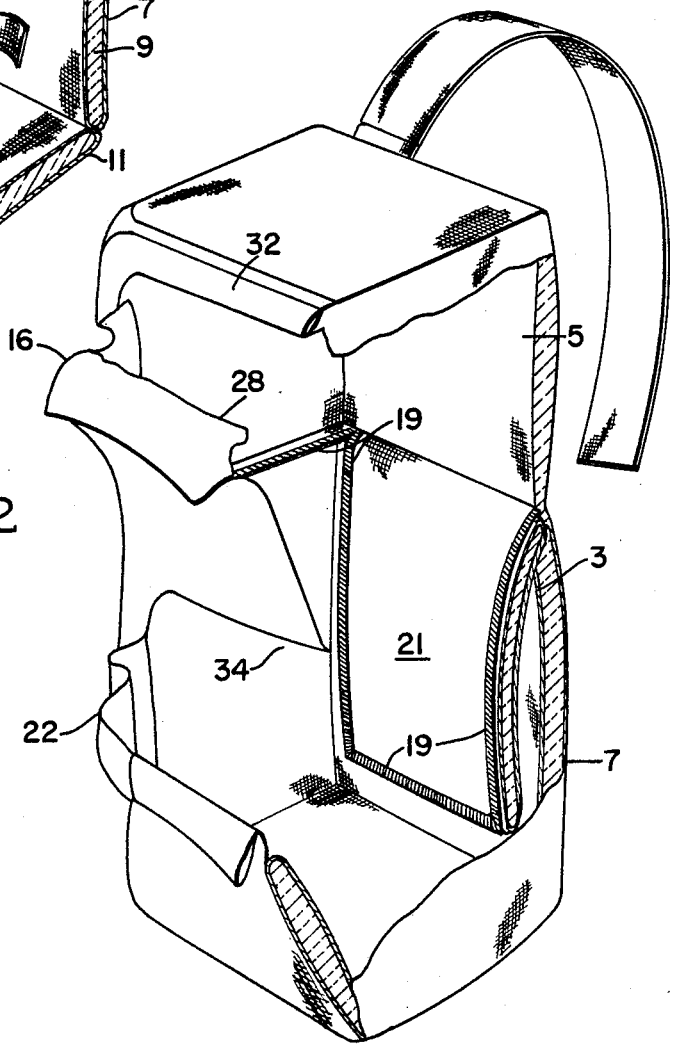
FIG. 2 is a partial perspective view showing the dividing means in the open and upright position.

Referring now to the drawings, and more particularly to FIG. 1, there is an isometrical view of the backpacking article. There is a plurality of compartments shown as references 3 and 5. There is a thermally insulated compartment 3 for carrying cold articles within a lower end of the backpack, and at least one other upper compartment 5, located above the thermally insulated compartment 3. There is a housing 7 formed of a combination of semi-flexible and composite, insulated, and waterproof material. The composite material 9 being located between layers of the semi-flexible material 11. There is also an area 8 surrounding the thermally insulated compartment for preventing thermal conductivity of cold objects from reaching the wearer of the backpack, while maintaining the desired lower temperature of the articles inside. There are shown in FIG. 1 carrying straps, 13 and 14, that are integrally attached to the housing 7 for adjustably adapting the backpack to the wearer. The compartments 3 and 5 are supported within the housing which is adapted so as to surround an access opening located at the rear side of the housing for permitting access to the insulated compartment. The upper compartment is accessed through a sealable panel 16, that are pivotably attached to the rear side of the housing at the bottom end 18. The lower compartment is accessed through a sealable panel 22 which is pivotably attached to the rear side of the housing at the bottom end 24.

There is a dividing means 21 between the thermally insulated compartment 3 and the upper compartment 5. The dividing means 21 is accessible through the opening of the upper compartment 5 and can be removed so as to make one single large compartment. The removal is generally accomplished through a sealable means such as a zipper 19 which then requires that the dividing portion be moved in an upright position against the back wall of the housing 7. The access openings panels 16 and 22 are fastened in a closed position to the upper and lower compartment respectively using a fastening material like hook and loop 28. The velcro-like material is convered over by flaps 32 and 34. In addition, each of the access openings 16 and 22 have attached integrally to them a pouch 25 and 26 respectively. These pouches are located outside of the composite material for receiving articles in a zippered sealed compartment which lies in substantial alignment with the access opening for panel 16 and 22 respectively. The zipper 27 seals the upper compartment pouch 25 and zipper 35 seals the lower compartment pouch 26. There are also stops 29 and 37 which limit the opening of the panel 16 and 22 respectively, so that, the panel will not open to an angle greater than approximately 45 degrees allowing ample access to the upper and lower compartments.

While this invention has been described in conjuction with specific embodiments thereof, it is evident that many alternatives, modifications, and variations will be apparent to those skilled in the art. Accordingly, the present invention is intended to embrace all such alternatives, modifications, and variations that fall within the spirit and scope of the appended claims.

What is claimed is:

1. A backpack having a plurality of compartments including a thermally insulated for carrying cold articles within a lower end portion of said backpack, which has at least one other compartment located above said thermally insulated compartment, said backpack further comprising;

A. A housing, formed of a combination of semi-flexible, waterproof material and composite, insulating material, said composite material bbeing located between layers of said semi-flexible material to define a first wall structure, said housing also formed by said semi-flexible material to define a second wall structure, said thermally insulated compartment being defined by said first wall structure, for preventing thermal conductivity of said cold articles from reaching a wearer of said backpack, while maintaining a desired lower temperature of said articles, said at least one other compartment being defined by said second wall structure;

B. Carrying straps which are integrally attached to the front side of said housing, for adjustably adapting said backpack to said wearer;

C. A first access opening located at the rear side of said housing, leading into said other compartment, a second access opening, located at the rear side of said housing and leading into said insulated compartment, a sealable panel within said housing and defined by said first wall structure, one edge of said panel being pivotably attached to the rear side of said housing, the remaining edges of said panel being removably attached to the remaining wall structure of said housing so as to be in a horizontal position between said compartments;

D. Said sealable panel dividing said thermally insulated compartment and said other compartment whereby each compartment is accessible through its respective first and second access openings and both compartments are accessible through the first opening so as a large single compartment is obtained when said panel is detached from said housing and positioned in an upright position.

2. A backpack according to claim 1, wherein said sealable panel is removably attached to said housing by a zipper which is attached to said housing and said panel in a substantially fixed position when said compartments are utilized as said insulated compartment and said other compartment.

3. A backpack according to claim 1, and further including a pair of pouches, each pouch being located on the rear side of said housing on each of said respective compartments, for receiving articles therein, a zipper on each pouch for sealing said pouches.

* * * * *